United States Patent [19]

Richter, Sr.

[11] Patent Number: 4,940,957

[45] Date of Patent: Jul. 10, 1990

[54] FLANGE ENGAGEMENT OF CAPTIVE TUBE IN ELECTROMAGNETIC CIRCUIT BREAKERS USING HALF SHELLS

[75] Inventor: Konrad J. Richter, Sr., Lawrenceville, N.J.

[73] Assignee: Heinemann Electric Company, Lawrenceville, N.J.

[21] Appl. No.: 314,172

[22] Filed: Feb. 22, 1989

[51] Int. Cl.[5] ..... H01H 9/02

[52] U.S. Cl. ..... 335/202; 200/293

[58] Field of Search ..... 335/202; 200/293, 295, 200/303, 308

[56] References Cited

U.S. PATENT DOCUMENTS 4,087,772 5/1978 Grenier ..... 335/202

*Primary Examiner*—Leo P. Picard
*Assistant Examiner*—Lincoln Donovan
*Attorney, Agent, or Firm*—Dann, Dorfman, Herrell and Skillman

[57] ABSTRACT

An electromagnetic circuit breaker uses opposed half shell cases which cooperate to enclose the breaker structure. The structure of the breaker is supported on a frame member which, in turn, is fixed to the housing. The electromagnetic coil for the breaker is supported on a platform extension of the frame wound on a bobbin spool, one flange of which rests against the platform. Passing through the core of the spool and the coil is a non-magnetic tubular core holder containing a magnetic core which is at least spring, and usually gravity, biased toward one end of the tube away from the pole piece closing the other end of the tube. The end of the tube closed by the pole piece is terminated in a radial flange which rests atop the other flange of the coil bobbin. Some part of the flange is, in turn, engaged in the assembly of the housing by shoulders which press the flange toward the bobbin and, in turn, against the supporting platform of the frame, thereby holding the whole structure in place. In preferred embodiments the flange is provided with diametrically opposed extensions which are engaged in slots or pockets on the respective casing sidewalls which function to apply the clamping force.

4 Claims, 1 Drawing Sheet

FLANGE ENGAGEMENT OF CAPTIVE TUBE IN ELECTROMAGNETIC CIRCUIT BREAKERS USING HALF SHELLS

The present invention relates to electromagnetic circuit breakers which employ a movable core, usually immersed in a liquid in a non-magnetic tube placed within the actuating coil of the circuit breaker. More specifically the present invention relates to means for clamping a flange on the tube in position relative to the frame supporting the armature and other elements of the mechanical linkage system which allows actuation of the circuit breaker to open its contacts.

BACKGROUND OF THE INVENTION

For many years it has been common practice to use a movable magnetic core within the actuating electromagnetic coil of a circuit breaker. Commonly the movable core has been a cylindrical structure supported and guided in a non-magnetic tube spring and/or gravity urged away from the pole piece, and rather commonly immersed in a damping fluid to delay the movement of the core toward the pole piece. When the breaker contacts are closed, the current flows through the coil and begins to urge the core toward the pole piece. However, only when the current reaches a predetermined overload level is the force strong enough to urge the core to the pole piece and, in turn, attract the movable armature of the breaker toward the pole piece, thereby tripping the breaker and releasing the contacts.

In the past, in order to positively hold the tube supporting the core in position it has been necessary to employ means mechanically connecting the tube to the coil and the frame, thus necessitating fabrication of a sub-assembly which is different for each type of coil and for each combination of other components which comprise the various sub-assemblies. Then it is necessary to maintain a sub-assembly inventory of many types of sub-assemblies ready for use in various types of breakers. Maintaining such an inventory is costly and separately assembling the sub-assemblies and the final breaker assembly is inefficient. At the present time, any changes to parts requires costly off the line salvage disassembly with losses of valuable parts.

THE NATURE OF THE PRESENT INVENTION

The present invention provides a means for clamping the tube holding the magnetic core in place in the course of final assembly of the breaker so that manufacture and inventory of sub-assemblies is not necessary. The construction provides an improved circuit breaker time delay tube retaining means that allows for assembly line manufacturing flexibility and eliminates the need for permanent manufacture of a special subassembly holding the tube in place by welding, soldering or like techniques which normally would require separate preassembly of parts or the manufacture of a special subassembly. In addition the new clamping technique allows for replacement rather than discarding of parts that deviate from the specification during testing and/or expensive salvage of other parts. The present technique also provides a mechanically secure means of clamping a time delay tube to the circuit breaker main frame without the use of a semi-permanent retaining ring or soft solder. Rather than requiring subassembly of parts, the whole assembly is completed on the main assembly line. The present invention allows for immediate production line changes using various tubes and coils and eliminates delay in building of product orders to a variety of specifications for delivery to customers. The advantages of the present invention are accomplished without loss of precise location of the tube pole piece to the tripping mechanism and positive clamping of the parts in position.

In accordance with the present invention the magnetic core containing tube is provided with a radial flange which allows it to be supported atop the coil bobbin which, in turn, is supported at its opposite end on a flange of the frame. Alternatively the flange of the tube may be directly supported on the frame. In either event, the present invention is directed to clamping the flange of the tube against a supporting surface using a clamping member which engages at least the tube flange and a portion of the breaker housing designed for that purpose and so arranged that it will cause the clamp to clamp directly down on the flange of the tube and hold it positively relative to the frame directly or through the coil bobbin.

More specifically, the present invention is used in an electromagnetic circuit breaker having a pair of breaker switch contacts electrically connected in series with a magnetic coil. An insulating breaker housing for the breaker has a pair of opposed housing members, at least in the region of the coil, which members are opened to assemble the breaker structure and closed and clamped together to contain the operating structure. The operating structure includes at least an actuation linkage for opening and closing the switch contacts supported on a frame which is fixed to the housing. The linkage has actuation means to open and close the switch contacts and a movable armature attractable to a pole piece for opening the switch contacts on overload. The pole piece terminates a non-magnetic tube supporting a magnetic core and is located within the magnetic coil and having a radially extending tube flange at an end closed by the pole piece. The actuating linkage and a coil supporting bobbin are supported on the frame. The tube flange is engaged by shoulders on the respective opposed sidewalls of the interior of the housing so that pressure is applied to urge the tube flange against its supporting surface and clamp in place the flange and all structure between the flange and the frame.

THE DRAWINGS

SPECIFIC DESCRIPTION OF THE DRAWINGS

Figure 2:
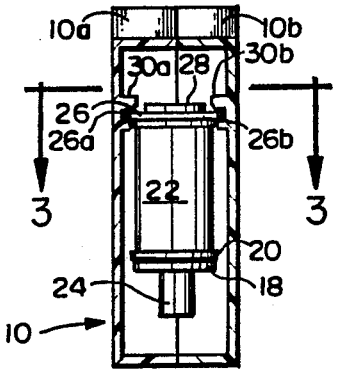
FIG. 2 is a sectional view taken along line 2—2 of FIG. 1.
Figure 3:
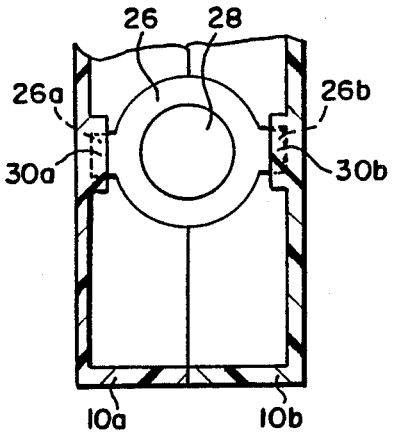
FIG. 3 is a sectional view taken along line 3—3 of FIG. 2.

Referring to the Figs., this invention concerns a breaker having a breaker housing 10 consisting of a pair of symmetrical insulating half shells **10*a* and 10*b* as seen in FIGS. 2 and 3. The half shells may be fixed together at selected locations by conventional fasteners 12 and 14, for example, near the respective corners. Much of the conventional structure of the breaker, including the breaker contacts, the actuating handle, the terminals and even the electrical connections, have been omitted. What is shown is the folded sheet metal frame 16 which is supported in fixed position on and between the half shells and which provides a shelf or platform 18 to support the bobbin 20 for the magnetic coil 22 of the breaker. Extending axially through the bobbin and the coil is a non-magnetic tube 24, terminated at its upper end in a radially extending flange 26 which preferably extends generally radially from the end of the tube and to which the pole piece 28 of the magnetic assembly is affixed. The tube contains and provides a guide for a cylindrical magnetic core member biased by a spring and gravity to the lower end of the tube 24 away from the flange. The tube also contains a viscous damping fluid to delay the movement of the core toward the pole piece 29 in response to overload currents in the coil. Such core movement, in turn, attracts the armature 30** causing the breaker to trip and the contacts to open.

In accordance with the present invention FIG. 2 is a schematic view taking some license in showing the half shells in section without sectioning the coil 22, the bobbin 20, the frame support 18 and the pole piece 28. In each half shell are pockets 30*a* and 30*b* preferably molded into the half shells and designed to retain and support extensions 26*a* and 26*b* of the flange. FIG. 3 also shows the general shape of the flange structure.

In the prior art the frame has been commonly supported by the half shells by providing sockets to retain the ends of rotatable shafts or pins journaled in the frame. Thus the frame is affixed relative to the housing half shells 10*a* and 10*b*. Similarly by inserting the flanges 26*a* and 26*b* into the pockets 30*a* and 30*b*, respectively, on the half shells 10*a* and 10*b* the tube 24 is supported relative to the housing and thus relative to the frame. Since the bobbin 20 for the coil 22 is also supported on frame support member 18, and the pockets 30*a* and 30*b* are positioned to hold the flange firmly against the coil in place, the coil is securely clamped between the flange 26 and the support 18.

Figure 1:
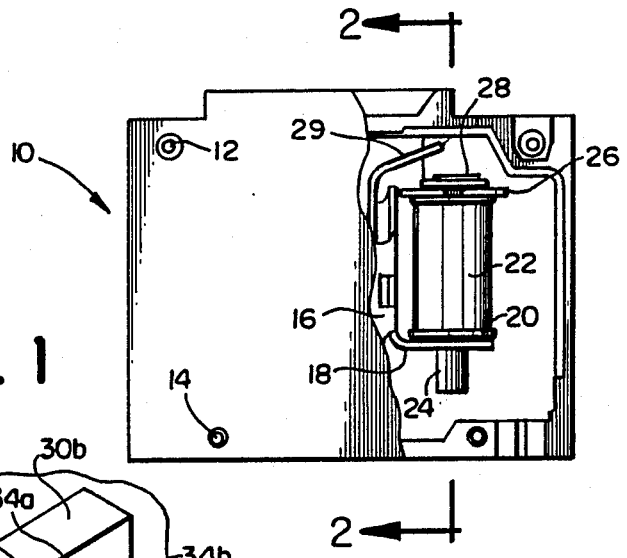
FIG. 1 is a side elevational view of a circuit breaker with one of the half shells of the housing broken away to expose the coil and tube support and associated structure but omitting much of the structure of the breaker.
Figure 4:
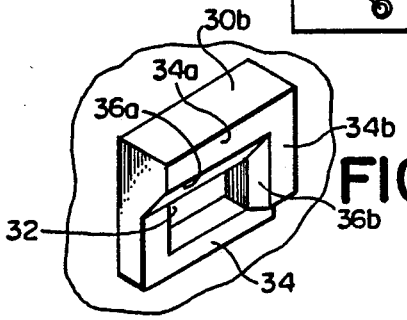
FIG. 4 is a perspective view showing one of the flange receptacles in one of the half shells of the breaker housing.

FIG. 4 shows the construction of pocket 30*b*. It will be understood that pocket 30*a* is similar but a mirror image construction. The actual flange retaining slot 32 is bound and defined by walls on every side providing a closely confined rectangular frame 34 for the flanges, in this case flange 26*b*. The walls seen in this perspective view above and to the right of the recess 34*a* and 34*b*, respectively, extend inwardly further from the wall of the half shell and the rest of the frame and are each provided with a transitional bevel 36*a* and 36*b* which help guide the flange 26*b* into slot 32.

It will be appreciated by those skilled in the art that the nature of the flange retaining pockets on the walls of the half shells may be greatly varied. In fact, in some instances because the structure is already sufficiently confined, all that is necessary is that a shoulder be provided to overlie the flange 26 or its extension 26*b* to hold the flange down against the spool or bobbin 20 of the coil 22. This is effective where the frame provides a support platform 18 beneath the coil bobbin as shown in this embodiment.

Other constructions will occur to those skilled in the art. All such modifications within the scope of the claims are intended to be within the scope and spirit of the present invention.

I claim:

1. An electromagnetic circuit breaker having a pair of breaker switch contacts electrically connected in series with a magnetic coil comprising an insulating breaker housing having a pair of opposed housing shell members, at least in the region of the coil, which members are opened to assemble the breaker structure and closed and clamped together to contain the operating structure, including at least an actuation linkage for opening and closing the switch contacts supported on a frame which is fixed to the housing and having actuation means to open and close the switch contacts and a movable armature attractable to a pole piece for opening the switch contacts on overload, the pole piece terminating a non-magnetic tube containing and guiding a magnetic core, the non-magnetic tube being located within the magnetic coil and having a radially extending tube flange at an end terminated in the pole piece, the actuating linkage and a coil supporting bobbin being supported on the frame, the tube flange being engaged by shoulders on the respective opposed sidewalls of the interior of the housing so that pressure is applied to urge the tube flange against its supporting surface and clamp in place the flange and all structure between the flange and the frame.

2. The electromagnetic circuit breaker of claim 1 in which the flange of the non-magnetic tube rests on one end of the bobbin and a portion of the frame supports the other end so that the bobbin is clamped by the flange against the frame.

3. The electromagnetic circuit breaker of claim 2 in which the flange is provided with extensions designed to fit within pockets in the inside walls of the opposed housing shell member to effectuate the clamping.

4. The electromagnetic circuit breaker of claim 3 in which the pockets are framed by extensions from the walls and at least the extensions on the side away from the coil bobbin are beveled to urge the flanges into the pockets.

* * * * *